US008631583B2

(12) United States Patent
Moss et al.

(10) Patent No.: US 8,631,583 B2
(45) Date of Patent: Jan. 21, 2014

(54) BAGEL SLICER

(76) Inventors: Dennis Moss, Pittsford, NY (US); Michael D. Moss, Lauderdale-by-the-Sea, FL (US)

( * ) Notice: Subject to any disclaimer, the term of this patent is extended or adjusted under 35 U.S.C. 154(b) by 302 days.

(21) Appl. No.: 13/194,961

(22) Filed: Jul. 31, 2011

(65) Prior Publication Data

US 2011/0283549 A1 Nov. 24, 2011

Related U.S. Application Data

(63) Continuation-in-part of application No. 11/983,293, filed on Nov. 8, 2007, now abandoned, and a continuation-in-part of application No. 11/589,576, filed on Oct. 30, 2006, now abandoned, and a continuation-in-part of application No. 11/263,092, filed on Oct. 31, 2005, now abandoned.

(51) Int. Cl.
*B26B 3/00* (2006.01)

(52) U.S. Cl.
USPC ..... 30/304; 30/151; 30/286; 30/295

(58) Field of Classification Search
USPC ..... 30/282–287, 289–291, 295, 304, 299, 30/151, 152
See application file for complete search history.

(56) References Cited

U.S. PATENT DOCUMENTS

| | | | |
|---|---|---|---|
| 751,251 | A | 2/1904 | Bollinger |
| 2,396,443 | A | 3/1946 | Singer |
| 2,453,220 | A | 11/1948 | Gustafson |
| 3,784,393 | A | 1/1974 | Sonn |
| 3,811,627 | A | 5/1974 | Bradbury |
| 3,918,157 | A | 11/1975 | Hyba |
| 3,924,881 | A | 12/1975 | O'Connor |
| 3,969,314 | A | 7/1976 | Grigull |
| 3,981,078 | A | 9/1976 | Alberti |
| 4,059,037 | A | 11/1977 | Gerson et al. |
| 4,127,555 | A | 11/1978 | Kendall-Smith |
| 4,174,340 | A | 11/1979 | Luders |
| 4,230,501 | A | 10/1980 | Howard |
| 4,255,825 | A | 3/1981 | Rigon |
| 4,356,230 | A | 10/1982 | Emanuel |
| 4,456,710 | A | 6/1984 | Luders |
| 4,530,924 | A | 7/1985 | Polony |
| 4,564,113 | A | 1/1986 | Mendler |
| D301,566 | S | 6/1989 | Heiberger |
| D325,326 | S | 4/1992 | Parven |
| 5,202,076 | A | 4/1993 | Carlstrom |
| 5,291,641 | A | 3/1994 | Morino |
| 5,350,792 | A | 9/1994 | Hess |
| 5,413,838 | A | 5/1995 | Azuma |
| 5,526,954 | A | 6/1996 | Georgiadis |

(Continued)

*Primary Examiner* — Phong Nguyen
(74) *Attorney, Agent, or Firm* — Tracy Jong Law Firm; Tracy P. Jong; Cheng Ning Jong

(57) ABSTRACT

A bagel slicer that comprises an oblong skirt and a pair of blades disposed within a cavity defined by the skirt. The oblong skirt has a length, a width, a top edge, a bottom edge, a wall connecting the top edge to the bottom edge, a top opening defined by the top edge and a bottom opening defined by the bottom edge where the top opening is substantially parallel to the bottom opening. The upper and lower blades are substantially parallelly disposed and offset vertically to form an overlap, each having a cutting edge. The cutting edge of each of the upper and lower blades is aligned with the bottom opening of the skirt and each blade is perpendicular to the bottom opening and substantially parallel to the skirt within the cavity.

19 Claims, 7 Drawing Sheets

(56) References Cited

U.S. PATENT DOCUMENTS

| | | | |
|---|---|---|---|
| 5,541,096 | A | 7/1996 | Nomura |
| 5,700,318 | A | 12/1997 | Brand |
| 5,756,211 | A | 5/1998 | Ittmann |
| 5,800,910 | A | 9/1998 | Harke |
| 5,804,116 | A | 9/1998 | Schmid |
| 5,837,761 | A | 11/1998 | MacPherson |
| 5,903,982 | A | 5/1999 | Gibson |
| 5,903,983 | A | 5/1999 | Jungmann |
| 5,916,947 | A | 6/1999 | Morris |
| 5,958,440 | A | 9/1999 | Burrell |
| 5,976,562 | A | 11/1999 | Krall |
| 5,991,985 | A | 11/1999 | Galbreath |
| D435,762 | S | 1/2001 | Detrick |
| 6,291,067 | B1 | 9/2001 | Taoda |
| 6,294,247 | B1 | 9/2001 | Watanabe |
| 6,322,302 | B2 | 11/2001 | Horton |
| 6,469,086 | B1 | 10/2002 | Neu |
| 6,585,989 | B2 | 7/2003 | Herbst |
| 6,759,140 | B2 | 7/2004 | Bittrich |
| 6,835,688 | B2 | 12/2004 | Morikawa |
| 7,019,048 | B2 | 3/2006 | Brehm |

BAGEL SLICER

CROSS-REFERENCE TO RELATED PATENT APPLICATIONS

This patent application is a continuation-in-part of applicants' co-pending patent application Ser. No. 11/983,293, filed Nov. 8, 2007, a continuation-in-part of co-pending application Ser. No. 11/589,576, filed on Oct. 30, 2006, a continuation-in-part of co-pending application Ser. No. 11/263,092, filed on Oct. 31, 2005.

BACKGROUND OF THE INVENTION

1. The Field of the Invention

The present invention is directed generally to a work holder for transforming a single piece of food product into a plurality of pieces of food product. There is also disclosed a food slicer and more particularly to a bagel slicer used for transforming a unity bagel into a plurality of bagel pieces.

2. Background Art

The preparation of food for cooking and eating usually involves cutting food items such as fruit, vegetables, meat, and dough-based products into smaller pieces for cooking or baking, combination with other items, and presentation to the consumer. For food items to be combined as slices with other foods, as in the preparation of bread, rolls, bagels, or other items too thick for eating alone and uncut, the slicing process is time-consuming, sometimes dangerous to the preparer, and often error-prone in that the results of a slicing operation can be uneven, unattractive, or even unusable in producing the final dish. These problems can result in food wastage, injury, and delays in preparation which are unacceptable in most meal preparation processes.

Bagels present unique problems in preparing a sandwich. A bagel sandwich is made by slicing the bagel in half on a plane perpendicular to the axis of the hole in the bagel. Bagels are quite firm and thick, and they present considerable resistance to a cutting blade when being cut. In addition, the outer surface of the bagel is smooth, round, and two-dimensionally convex, making it highly unstable for cutting except when laid flat on a surface and cut horizontally. Horizontal cutting requires more energy and time than downward (vertical) cutting, both to execute the cut and to hold the bagel in position.

The smooth, convex, outer surface of the bagel presents an additional problem when attempting to cut the bagel into thirds or multiple slices on planes perpendicular to the axis of the hole. Most cutting blades directed at a surface at an angle tend to slide along that surface rather than 'bite' into it for the cut. Consequently, food preparers do not often try to make bagel sandwiches or other multilayered bagel preparations using conventional cutting methods.

A bagel is most safely cut by laying it on a flat surface, placing the palm of one hand on the top surface of the bagel, and engaging the outer circular edge of the bagel with a serrated bread knife. The knife is moved parallel to the plane of the support surface while the person keeps the fingers of the hand on the bagel and out of the cutting plane of the knife. In certain cases, thinner bagel materials are desired to enable a food preparer to stuff more fillings such as meat, cheese slices, vegetables, etc. into a sandwich style product. This often requires multiple cuts of a bagel or shaving of cut surfaces upon producing a first initial cut. Such practice not only tremendously increases the amount of food preparation effort but also increases the potential for injury due to accidental cuts.

Many people are injured while cutting bagels. The source of the injuries is often improper equipment or improper procedures. For example, many people will use an ordinary, non-serrated knife. Such knives more easily slip on the smooth outer convex surface of the bagel and cut the hand that holds the bagel. Other injuries occur when the knife slices through the bagel into the hand holding the bagel, or when the bagel is cut while standing it on its convex edge.

The prior art has presented several devices which attempt to solve these problems. U.S. Pat. No. 2,396,443 of Singer discloses a multiple slicing device in which a multiplicity of straight and parallel knives are rigidly held in place. There is no shield protecting a user from injuring himself with these knives, and the Singer device is relatively unsafe to use.

U.S. Pat. No. 2,453,220 of Gustafson discloses a slicing knife assembly comprised of a body portion and a blade. Although one side of the Gustafson knife assembly is shielded, the other side of the blade, and its bottom surface, are unshielded.

U.S. Pat. No. 3,981,078 of Alberti discloses an electric knife with two mutually reciprocating cutting blades. As with the Singer and Gustafson devices, the user of the Alberti device has ample opportunity to cut himself as well as a bagel, the cutting blades of Alberti also not being shielded.

U.S. Pat. No. 5,903,982 of Gibson provides a handheld bagel sheer whose blade is shielded by legs on either side of such blade. However, the tip of the blade is not shielded, and the tip of such blade is not rigidly fixed in place on both of its ends. Thus, such blade is free to slide along the surface of the bagel and/or deflect during the cutting process.

U.S. Pat. No. 751,251 of Bollinger et al. (hereinafter Bollinger) discloses a two bladed bread knife, where the blades are vertically and horizontally offset. Although there are two blades, the knife is incapable of making two complete cuts in one slicing action as one of the knives is vertically offset.

U.S. Pat. No. 4,059,037 of Gerson et al. (hereinafter Gerson) discloses a slicing device having two racks of parallel thin blades intermeshed in a cross disposition for slicing objects by a pushing action. However, although having overlapped blades, Gerson is not suitable for making reciprocating cuts or sawing as the pushing action would crush an object intended to be cut.

U.S. Pat. No. D325,326 of Parven (hereinafter Parven) discloses a device which appears to be a single bladed knife for sliding bread or bagel. However, it fails to disclose a knife that is safe to use as the knife is exposed despite what appears to be a handle which runs the entire length of the knife.

It is an object of this invention to provide a blade assembly adapted to cut bagels that is safer to use and more effective than prior art blade assemblies.

SUMMARY OF THE INVENTION

The present invention is directed toward a bagel slicer for producing a plurality of slices from a single piece of food product. The bagel slicer comprises an oblong skirt having a length, a width, a top edge, a bottom edge, a wall connecting the top edge to the bottom edge, a top opening defined by the top edge, a bottom opening defined by the bottom edge and a cavity defined by the wall, wherein the top opening is substantially parallel to the bottom opening. The food slicer further comprises an elongated upper blade and an elongated lower blade, wherein each of the upper and lower blades includes an elongated plate having a length, a height, two ends, a cutting edge and a second edge opposingly disposed from the cutting edge. The upper and lower blades are substantially parallelly disposed and offset vertically to form an overlap. Each blade is configured to laterally deflect a maximum distance of 0.13 inch with a force of 5 lbs. applied perpendicularly at about mid-section of the length of each plate. The cutting edge of each of the upper and lower blades is aligned with the bottom opening of the skirt and each blade is perpendicular to the bottom opening and substantially parallel to the skirt within the cavity. The food slicer is configured to receive the single piece of food product at the bottom opening and cut the single piece of food product to simultaneously result in three pieces of food product at the top opening without exposing the cutting edge of each blade outside of the cavity, thereby ensuring safety of a user of the food slicer.

Accordingly, it is a primary object of the present invention to provide a food slicer that is safe to handle without paying undue attention.

It is another object of the present invention to provide a food slicer that produces three slices of food product of relatively repeatable and consistent thickness and consumer acceptable cut surfaces from a single piece of food product without undue training.

It is yet a further object of the present invention to provide a food slicer which cooperates with a hand while being used to cut a food product rather than being confined to cooperate with a static supporting surface such as a cutting board or a table top.

It is yet a further object of the present invention to provide a manually operated food slicer which is capable of producing three pieces of food product from a single piece of food product quickly.

It is yet a further object of the present invention to provide a food slicer where a user's food product supporting hand is far removed from the blades of the slicer such that the user does not run the risk of getting his/her hand cut.

It is yet a further object of the present invention to provide a food slicer having blades that are configured to contact food product only and not with either its user or a supporting surface for the food product such that the blades remain sharp for a longer period of time.

It is yet a further object of the present invention to provide a food slicer having a skirt which aids in centering a piece of food product to be cut, thereby producing food slices of consistent thicknesses and having consumer acceptable cut surfaces.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
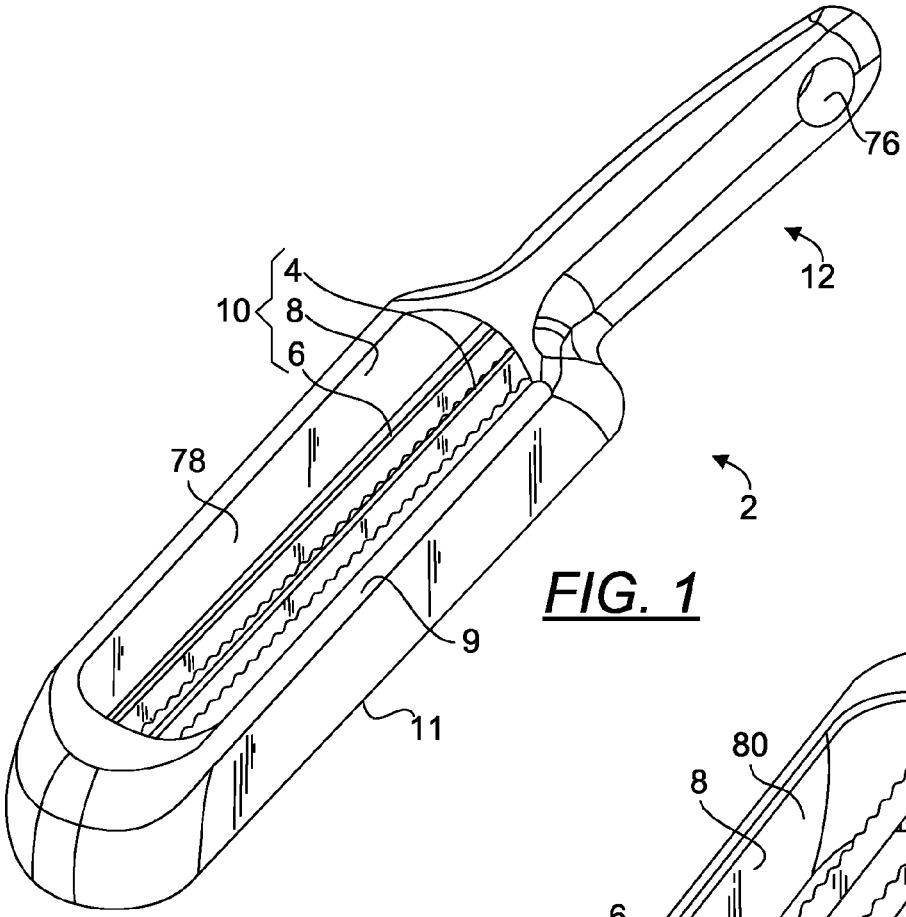
FIG. 1 is a top perspective view of a bagel slicer according to the present invention.

2-bagel slicer
4-upper blade
5-displaced upper blade
6-lower blade
8-skirt
9-top edge of skirt
10-blades and skirt assembly of bagel slicer
11-bottom edge of skirt
12-handle
14-bagel
16-hand
18-outer bagel slice
20-center bagel slice
22-cut
24-width of cavity of skirt
25-horizontal spacing between upper and lower blades
26-height of skirt
28-length of skirt
30-length of bagel slicer
32-distance between blade and skirt
34-distance between blades
36-length of blade
38-half of length of blade
40-deflection of blade at center of blade
42-force applied at center of blade
44-zone of minimum distance between blades
46-zone of maximum distance between blades
48-zone of normal distance between blades
50-minimum distance between blades
52-maximum distance between blades
54-normal distance between blades
56-cutting edge of upper blade

58-cutting edge of lower blade
60-distance of cutting edge of lower blade from the bottom edge of skirt
62-average height of overlap of upper and lower blades
64-average height of blade
65-combined height of blades
66-surface area of tang embedded in skirt
68-peak of serration
70-valley of serration
72-area of bread where bunching occurs
74-spine
76-loop
78-top opening
80-bottom opening
82-unstaggered blades
84-portion of middle slice which comes under compression
86-portion of middle slice at exit of blades
88-angle between skirt and blades
90-serrated knife edge
92-direction in which an outer bagel slice is displaced
CDEF-parallel planes Particular Advantages Of The Invention The present bagel slicer provides a tool for safely cutting a single piece of food product simultaneously into three pieces of food product. Conventionally, multiple cuts are required to transform a bagel into three pieces. A skirt disposed around the blades of the present slicer not only serves as a guide for channeling or funneling a bagel to be cut but also serves as a shield to prevent accidental contact of cutting edges on a user's hand. The present bagel slicer removes the guesswork necessary to position a bagel to be cut and lowers the skills required to make consistent cuts of a bagel into multiple pieces. The blades of the present slicer are sufficiently stiff and rigidly mounted such that cuts may be consistently made in order to produce bagel pieces of repeatable and consistent thickness and consumer acceptable cut surfaces. The blades of the present slicer are staggered (vertically offset) to form an overlap which aids in producing bagel pieces of consistent thickness with uniform cut surfaces. The concept of staggering the blades prevents bunching of portions of a bagel as the bagel is being cut. Unlike conventional knives, the present food slicer does not require that a food product be placed on a static supporting surface such as a cutting board or a table surface before cuts can be made. The present food slicer is instead configured to receive and cut a food product that is supported in the palm of a hand or the pulling action of a hand, thereby eliminating the need for a cutting surface or the possibility of creating damage to the user or a cutting surface.

DETAILED DESCRIPTION OF A PREFERRED EMBODIMENT

Although the present food slicer is optimized for cutting a single bagel to yield three slices of bagel pieces, it shall be apparent upon reading the ensuing disclosure that such a food slicer is suitable for cutting other food products having similar hardness, texture, shape and size, especially bread products. The Applicants have found, through extensive experimentation, that the quality of cut surfaces of resulting bagel slices depend heavily on the sharpness of blades used for making cuts, the rigidity of the blades with respect to the skirt and the positioning of the upper blade with respect to the lower blade. The Applicants have found that blades which have been polished to mirror finish also function significantly more efficiently than unpolished blades in avoiding bunching of bagel materials between blades or between a blade and the skirt. In the following description, emphasis will be placed on factors affecting the quality of cut surfaces and the features of the present bagel slicer which provide high quality and customer acceptable cut surfaces. The terms "customer acceptable" as used herein to describe the quality of cut surfaces and thickness consistencies of bagel slices shall mean cut surfaces that are free from torn and/or compressed portions, resulting bagel pieces that are consistent in thickness and in general, cuts that are satisfactory to food preparers and consumers.

Figure 2:
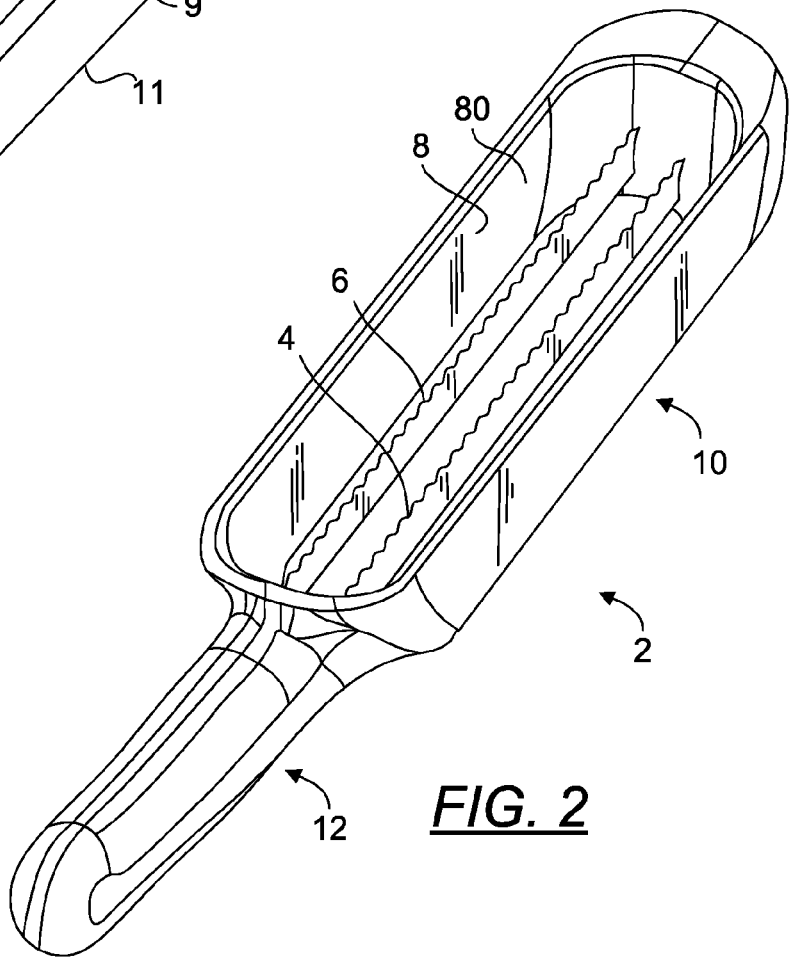
FIG. 2 is a bottom perspective view of the bagel slicer of FIG. 1.

The present slicer is configured for cutting bagels of various sizes and textures. A bagel is conventionally shaped by hand into the form of a ring from yeasted wheat dough, which is first boiled for a short time in water and then baked. The resulting bagel is a dense, chewy, doughy interior with a browned and sometimes crisp and hard exterior. For example, a bagel that works well with the present slicer has a diameter of from about 5 inches to about 6 inches and a thickness of from about 1.5 to about 2.0 inches. FIGS. 1 and 2 are top and bottom perspective views respectively of a bagel slicer 2 according to the present invention. The bagel slicer 2 comprises a blades and skirt assembly 10 which includes an oblong skirt 8, an elongated upper blade 4 and an elongated lower blade 6. The skirt 8 is essentially an oblong shaped structure having a length, a width, a top edge 9, a bottom edge 11, a wall connecting the top edge 9 to the bottom edge 11, a top opening 78 defined by the top edge 9, a bottom opening 80 defined by the bottom edge 11 and a cavity defined by the wall. The top opening 78 is disposed substantially parallel to the bottom opening 80. The upper and lower blades 4, 6 are disposed within the cavity. Each blade 4, 6 includes an elongated plate having a length, a height, two ends, a cutting edge and a second edge opposingly disposed from the cutting edge. In one embodiment, the upper and lower blades 4, 6 are offset vertically to form an overlap. The cutting edge of each of the upper and lower blades 4, 6 is aligned with the bottom opening of the skirt 8 and each blade 4, 6 is disposed perpendicularly to the bottom opening and parallelly to the skirt. As used herein, the term "substantially parallel" includes variances of from about 0 to about 3 degrees.

The bagel slicer 2 further comprises an ergonomically designed handle 12 fixedly attached to a portion of the skirt 8 such that the bagel slicer 2 is more easily held or maneuvered. In one embodiment as depicted in FIG. 1, the bagel slicer 2 further includes a loop 76 configured for hanging the bagel slicer 2 when not in use. Food grade plastic such as polypropylene, polycarbonate and polystyrene have been found suitable as materials for constructing the skirt 8 as they are light weight, sturdy and capable of withstanding repeated use without cracking.

Figure 3:
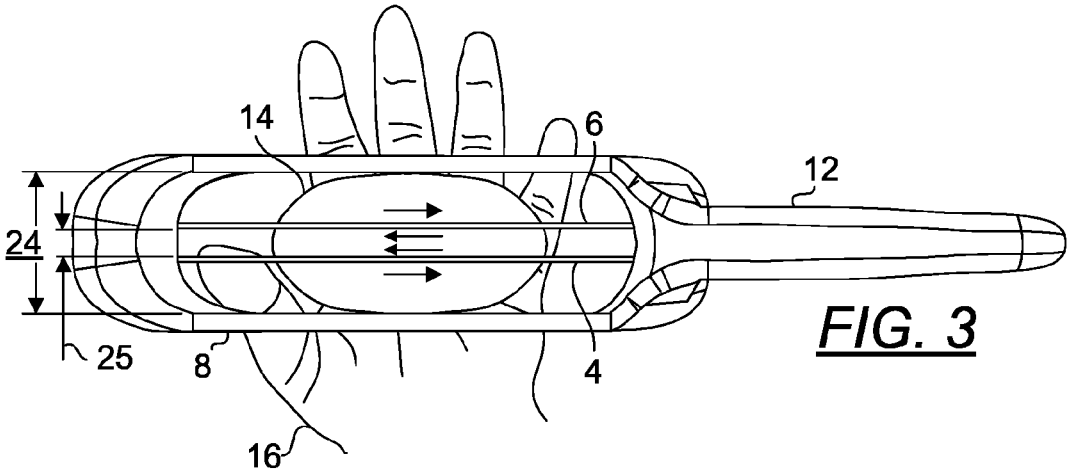
FIG. 3 is a top orthogonal view depicting the placement of a bagel slicer with respect to a bagel and a palm holding the bagel in place to be sliced with the bagel slicer.
Figure 4:
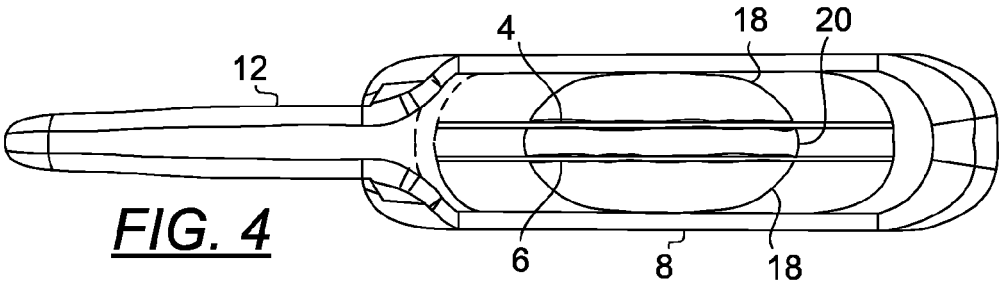
FIG. 4 is a top orthogonal view depicting the result of having cut the bagel of FIG. 3 into three slices.

FIG. 3 is a top orthogonal view depicting the placement of a bagel slicer with respect to a bagel 14 and a palm 16 holding the bagel 14 in place to be sliced with the bagel slicer 2. FIG. 4 is a top orthogonal view depicting the result of having cut the bagel 14 of FIG. 3 into three slices 18, 20. In use, a bagel 14 is inserted through the bottom opening 80 into the cavity of the skirt 8 with one end of the bagel's outer periphery contacting the lower blade 6 first. Upon insertion, the opposing end of the bagel's outer periphery contacting the lower blade 6 is then supported using the palm 16 of a hand. The bagel slicer 2 is then moved in a reciprocating motion, much like a reciprocating saw, in the lengthwise direction of the bagel slicer 2 to start creating at least one cut by the lower blade 6 in the bagel 14. As the cut by the lower blade 6 deepens, the upper blade 4 eventually comes in contacting or cutting engagement with the bagel 14. As the bagel clears the bottom opening 80 at one end, the opposing end starts to emerge through the top opening 78. It is at this point that the hand used in supporting the bagel 14 earlier can now be used to pull the bagel 14 through to the opposing end.

Although equipped with two blades, Bollinger's knife differs from the present slicer in at least four different respects. First, Bollinger's knife is incapable of making two complete cuts although equipped with two blades. Bollinger's knife was designed to cut bread materials that are supported on a static surface. As such, the upper blade of Bollinger is incapable of reaching the static surface on which bread materials are disposed, thereby leaving a bread portion as high as the vertical offset of the upper blade to connect to a partially cut slice of bread. The mere advantage of having two blades as shown in Bollinger lies in the ability to space slices consistently. Second, Bollinger's knife must be used with a static cutting surface as the lower blade is maneuvered against the cutting surface to finish each cut. Third, Bollinger's blades are offset vertically without overlap as evidenced by lines 20-26 and lines 82-94 of Bollinger as follows:

"Our invention contemplates a plurality of knives attached to a common handle and arranged parallel in different horizontal planes, the outermost knife being below the adjacent knife, so that in cutting the outermost knife will enter the material before the next adjacent knife and will leave in the same order."

"By reason of our peculiar arrangement of the knives, however, there is no obstruction of the slices nor interference between the knives, the pressure in slicing bread is not in the same plane but in two different planes, and there is no chance for the cut slice to wedge between the knives, for the second slice begins at the level of the top of the first knife, and the slices naturally lean outward over the knives without interference therebetween, and each knife works as freely as a single knife would do and will cut bread and other like material perfectly."

In contrast and as will be explained elsewhere in the document, the Applicants discovered that without an overlap, the blades are incapable of producing customer acceptable cuts. Fourth, Bollinger further lacks a rigid blades and skirt assembly as one end of each of Bollinger's blades is unsecured.

Gerson discloses a slicing device having two racks of parallel thin blades intermeshed in a cross disposition for slicing objects. Although disposed in a laterally overlapped fashion, the blades are not suitable for sawing a bagel as the pushing action required to cut using this device undoubtedly crush an object having the shape and textures of a bagel. It shall also be noted that even if the present blades are replaced with Gerson's cross disposed blades, the resulting bagel slices would still differ tremendously. As a bagel is being sawn, the user of the device would experience higher forces at the limits of the sawing action as saw-bagel contact surface areas increase at these limits. Therefore, the user experiences tremendous differences in the required cutting forces within a cutting cycle and would need to adjust to the differences accordingly. In contrast, with the present slicer, the amount of force required to slice a bagel within a cutting cycle does not change significantly. Therefore, higher quality cuts may be produced with less effort using the present slicer. Further, Gerson's blades would cause binding and material breakage if they were utilized in cutting bagel materials as the blades are not vertically offset (or unstaggered) as will be described in FIG. 12.

Referring back to FIG. 3, the width 24 of the cavity of skirt 8 preferably ranges from about 1.8 to about 2.1 inches while the distance 25 between the blades 4, 6 preferably ranges from about 0.44 to about 0.46 inch. In practice, the use the three cut slices of a bagel is a matter of choice. In some cases, the middle slice 20 is discarded while in other cases, the middle slice 20 is reconstituted or used in a triple-decker/club sandwich. In yet another instance, middle slices 20 which are free of crusts are used as bread materials for two-slice sandwiches. In a further instance, outer slices 18 are flipped inside out such that the crusts face fillings between the outer slices 18.

Figure 5:
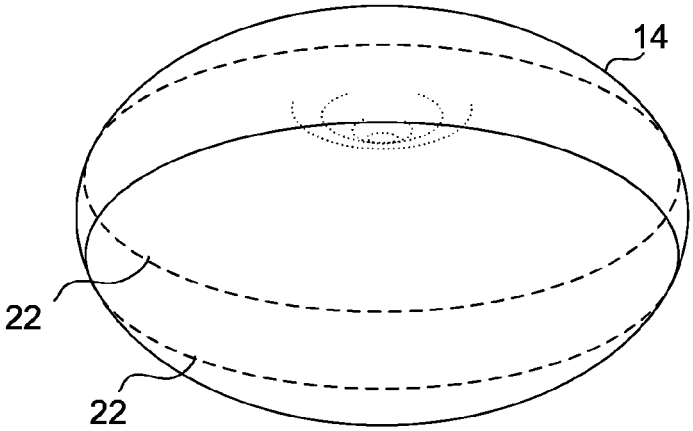
FIG. 5 is a top perspective view of a bagel depicting the cuts that are to be made with the present bagel slicer.
Figure 6:
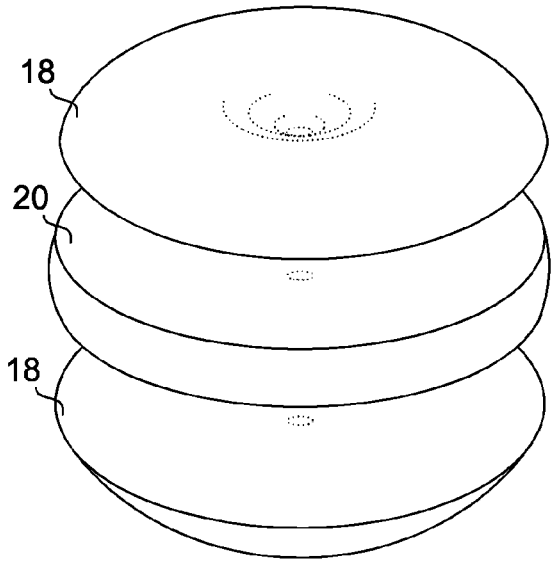
FIG. 6 is a top perspective view depicting slices of bagel as a result of cutting the bagel of FIG. 5 with the present slicer.

FIG. 5 is a top perspective view of a bagel depicting the cuts 22 that are to be made with a bagel slicer of the present slicer 2. FIG. 6 is a top perspective view depicting outer and middle slices 18, 20 of bagel as a result of cutting the bagel 14 of FIG. 5 with the present bagel slicer 2.

Figure 7:
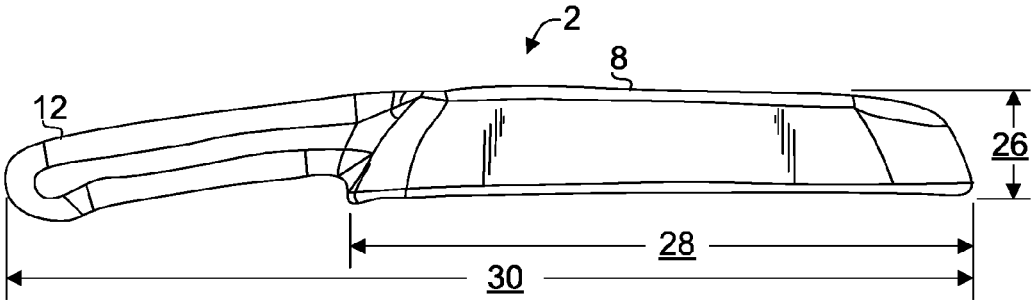
FIG. 7 is a side orthogonal view of a bagel slicer.

FIG. 7 is a side orthogonal view of a bagel slicer 2 according to the present invention. The length 28 of the skirt 8 preferably ranges from about 8.625 to about 9.75 inches while the height 26 of the skirt 8 preferably ranges from about 1.45 to about 1.625 inches. The overall length 30 of the bagel slicer 2 including the handle 12 preferably ranges from about 13 to about 15 inches.

Figure 8:
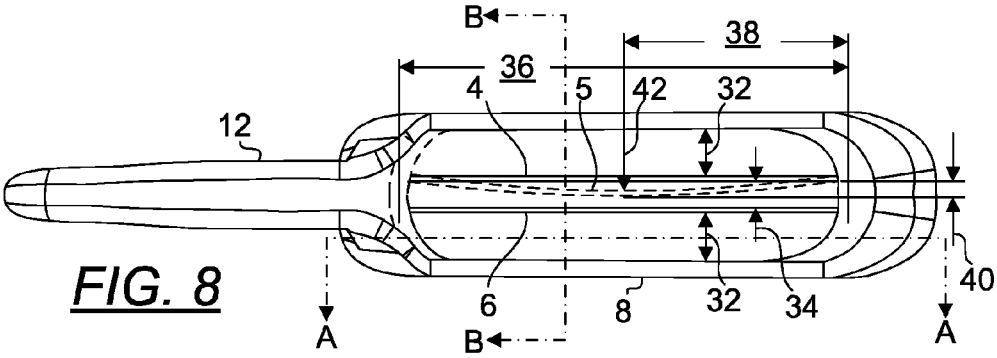
FIG. 8 is a top orthogonal view of a bagel slicer depicting the deflection of a blade as a force is applied to the blade.

FIG. 8 is a top orthogonal view of a bagel slicer depicting the deflection 40 of a blade as a force 42 is applied to the blade. Although a force is depicted as being applied in one direction, it shall be understood that as a bagel is being cut, a force may also act in a direction opposite to the force 42 depicted, thereby deflecting the blade 4 in the opposite direction. The lower blade 6 may experience a force similar to that of the upper blade 4. As a bagel is being cut, the distance 32 between the skirt 8 and a blade 4, 6 and the distance 34 between the blades 4, 6 can change. The Applicants discovered, through numerous tests of the present bagel slicer 2, that the stiffness of the blades is of utmost importance as blades that are constructed from a soft material, blades that are improperly fabricated or blades that are improperly secured tend to deflect excessively as a food product is cut to result in bagel slices of inconsistent thickness and cut surfaces which are severely torn in spots. A common misconception that arises when dealing with cutting a food product is that the cutting edge can be relatively flexible as a food product especially a bread product such as a bagel is generally soft. In order to properly quantify the amount of deflection found to be acceptable to consumers, the Applicants have devised a test to gauge deflection due to an applied force. In this test, the present bagel slicer 2 is fixedly secured at both lengthwise ends (tangs) so that a force 42 of known magnitude can be repeatedly applied perpendicularly to the midsection (at half way 38 of the total length 36 of blade 4, 6) of a blade as the deflection is at its maximum at this point. The Applicants conducted tests on multiple blades, of which average results are included herein to contrast a blade that yields consumer acceptable cuts to cuts that result in "torn" cut surface texture in spots. The following table shows the average magnitude of deflection as a force 42 is applied perpendicularly to the midsection of a blade 4 of the present bagel slicer to result in a blade 5 in its displaced position. A blade was loaded at minimum three times and a corresponding deflection reading was taken for each. An average deflection was then calculated for each applied force.

| Force (lbs.): | Average Deflection (inches): |
|---|---|
| 1 | 0.0045 |
| 2 | 0.0125 |
| 3 | 0.0425 |
| 4 | 0.0640 |
| 5 | 0.0875 |
| 6 | 0.1120 |
| 7 | 0.1305 |
| 8 | 0.1313 |

-continued

| Force (lbs.): | Average Deflection (inches): |
|---|---|
| 9 | 0.1495 |
| 10 | 0.1690 |

In contrast, bagel slicers having blades which produce unsatisfactory (consumer unacceptable) results were tested with 5 lbs applied perpendicularly at midsection of a blade. The deflections ranged from 0.221 inch to 0.302 inch as compared to a maximum of 0.13 inch of the present bagel slicer.

In one embodiment where blade deflection is considered satisfactory, each blade is constructed from an elongated plate with a spine 74 disposed on the second edge while a series of serrations is disposed on the cutting edge. The ends of blades 4, 6 of this invention are hermetically sealed. That is, when immersed in water, there are no cavities allowing water and/or food particles and/or other degradable material to be trapped between the blade and the plastic.

Figure 9:
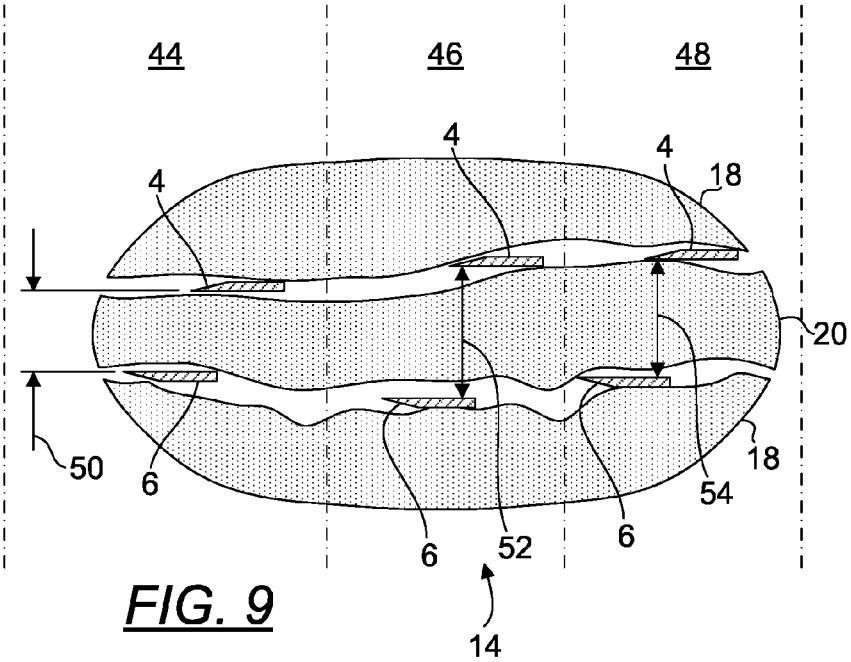
FIG. 9 is a side view of a bagel depicting problematic cuts that can result from deflections of blades.

FIG. 9 is a side view of a bagel depicting problematic cuts that can result from deflections 40 of blades. The bagel 14 is shown to experience three zones 44, 46 and 48. In zone 44, due to deflection of one or both blades 4, 6, the distance 50 between the blades 4, 6 is at a minimum, thereby resulting in a middle slice 20 that is narrower than a normal thickness. Again, in zone 46, due to deflection of one or both blades 4, 6, the distance 52 between the blades 4, 6 is at a maximum, thereby resulting in a middle slice that is thicker than a normal thickness. Zone 48 depicts a condition where the blades 4, 6 do not experience significant deflection, thereby resulting in a distance 54 between the blades 4, 6 that produces a middle slice 20 of normal thickness. As demonstrated by this figure, if the bagel being cut experiences deflections of the blades 4, 6 throughout a cut, the resulting slices can have serious thickness inconsistencies, poor cut surfaces, tearing, binding and compression.

Figure 10:
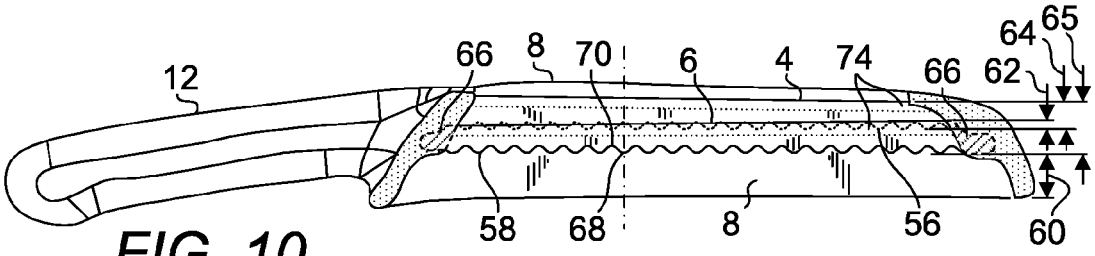
FIG. 10 is a side cutaway partially transparent orthogonal view as taken along line A-A of the bagel slicer of FIG. 8.
Figure 11:
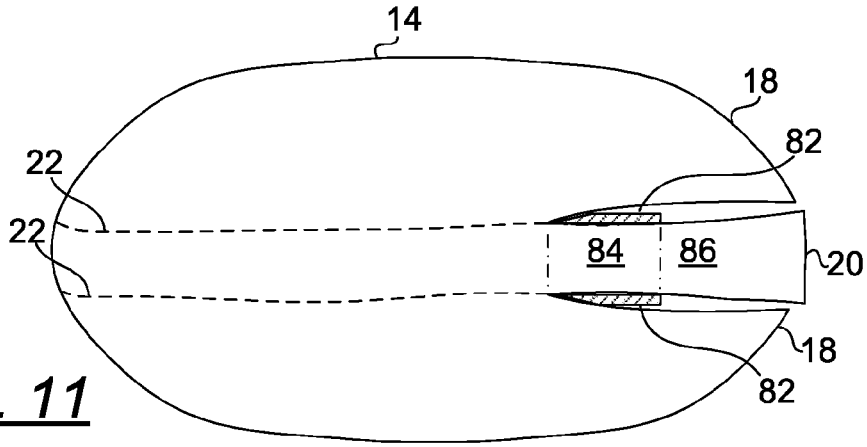
FIG. 11 is a side view of a bagel being cut with unstaggered blades.
Figure 12:
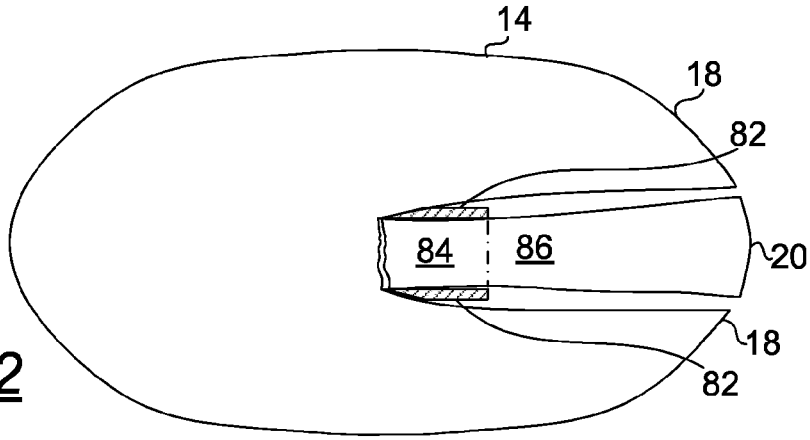
FIG. 12 is a side view of a bagel being cut with unstaggered blades of FIG. 11 to a breaking point.

FIG. 10 is a side cutaway partially transparent orthogonal view as taken along line A-A of the bagel slicer of FIG. 8. FIG. 11 is a side view of a bagel being cut with unstaggered blades. FIG. 12 is a side view of a bagel being cut with unstaggered blades of FIG. 11 to a breaking point. Referring back to FIG. 10, the concept of minimum blade overlap is utilized to ensure proper cutting of the bagel. Such blade overlap can best be realized by viewing the product from the side and registering the blades within the skirt 8 such that the top of the lower blade 6 coincides with the bottom of the upper blade 4 to form an overlap 62. As depicted in FIG. 10, the cutting edge 56 of the upper blade 4 is disposed at a higher level than the cutting edge 58 of the lower blade 6. Such blade overlap allows the cutting edge of one blade to lead the cutting edge of the other blade. The offset arrangement of the leading cutting edges reduces friction experienced by two blades that are both parallel and aligned. Where the blades are aligned with their lower edges in the same plane, the middle slice between the blades may become compressed. If so, the compressed slice presses against both the blade surfaces and increases frictional force that inhibits cutting as illustrated in FIG. 12. FIGS. 11 and 12 depict the interactions between the unstaggered blades and the bagel which cause the bagel 14 to rip or break. As cuts 22 are being made, a portion 84 of the middle slice 20 between the unstaggered blades start to experience compression. As cuts 22 progress, the portion 84 of the middle slice 20 between the unstaggered blades begins to exit and experiences decompression as evidence by the flaring in the portion 86 of the middle slice 20. Upon cutting deeper into the bagel 14, the compression developed in portion 84 becomes so large that the middle slice 20 starts to break off from the bagel 14 as further cutting is attempted as illustrated in FIG. 12.

Figure 13:
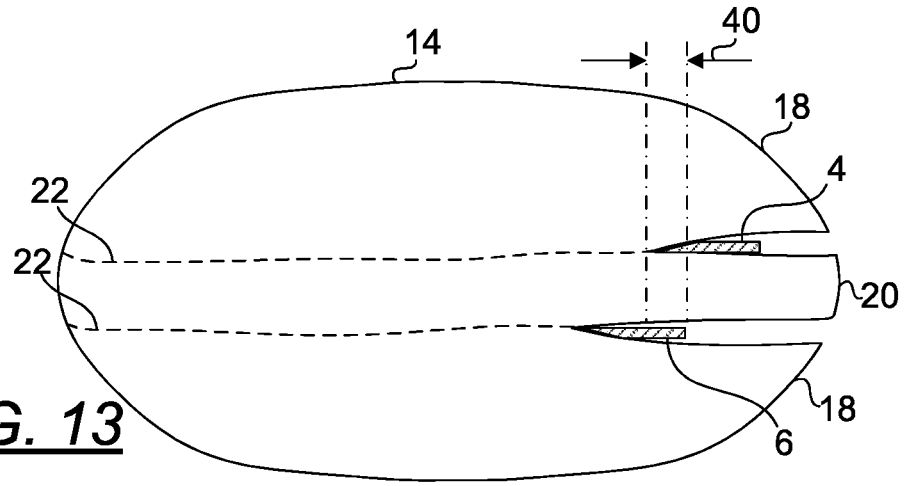
FIG. 13 is a side view of a bagel being cut with staggered blades with an overlap.
Figure 14:
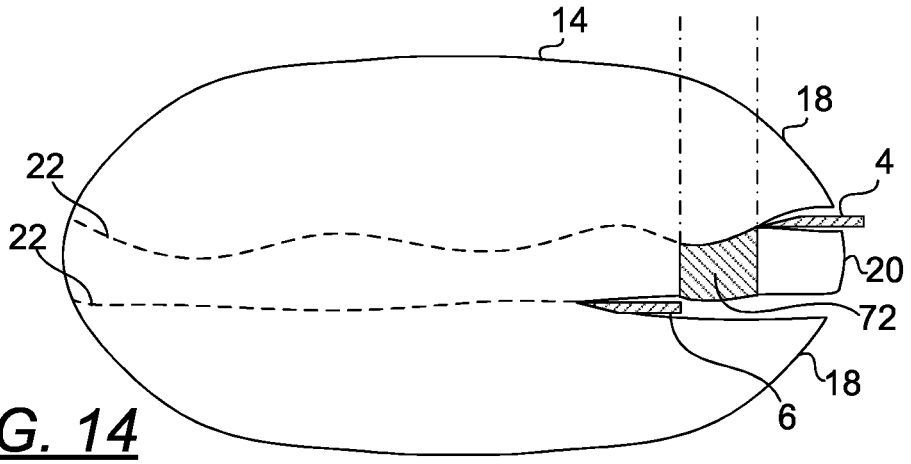
FIG. 14 is a side view of a bagel being cut with staggered blades without an overlap.

By jogging or offsetting the relative depths of the cutting edges of the blades with respect to each other, the cutting/leading edge of the lower blade 6 acts, at least initially, like a single blade. There is no compressive force exerted on the inside surface of the leading edge of the lower blade because the other blade is vertically offset from it. FIGS. 13 and 14 illustrate the importance of having an overlap 62. FIG. 13 is a side view of a bagel being cut with staggered blades with an overlap. FIG. 14 is a side view of a bagel being cut with staggered blades without an overlap. As illustrated in FIG. 14, bunching of the bagel material can occur in a portion 72 of the middle slice 20 between the upper blade 4 and the lower blade 6 in the cutting direction as the lower blade 6 is unavailable to support the middle slice 20 near the second edge of the lower blade 6 as the upper blade 4 exerts a force towards the lower blade 6. Referring to FIG. 13, in contrast, the overlap 62 ensures that the middle slice 20 is supported near the top edge of the lower blade 6 against a force exerted by the upper blade 4 towards the lower blade 6.

The overlap 62 preferably measures from about 0.039 to about 0.236 inch or 10 to 30% of the combined height 65 of the blades 4, 6. The upper and lower blades 4, 6 are substantially parallelly disposed and offset vertically to form the overlap 62. The height 64 of each blade 4, 6 as measured from the top edge to the bottom edge ranges from about 0.43 to about 0.54 inch.

The Applicants further discovered that the type of cutting edge of a blade plays an important role in determining the quality of cut surfaces. The present bagel slicer 2 comprises a series of serrations having peaks 68 and valleys 70. The Applicant further discovered that by disposing the peaks and valleys of one blade alternatingly against the peaks 68 and valleys 70 of the other blade, the quality of cut surfaces can be further enhanced as potential bunching of bagel materials is further eliminated during their interaction with the blades in the longitudinal direction of the blades. Such alternating configuration can best be realized by again viewing the bagel slicer 2 from the side as depicted in FIG. 10. A peak 68 of the upper blade 4 is shown to correspond to a valley 70 of the lower blade 6.

It shall also be noted that, in order to produce consumer acceptable cut surfaces, one further consideration lies in the way a blade 4, 6 is secured to the skirt 8. Each blade 4, 6 is secured at its ends/tangs to the skirt. The Applicants found that suitable cut surfaces can be produced by embedding the ends in the skirt 8. The portions of skirt 8 configured to engage the ends of the blades are integrally formed with the skirt 8, thereby enhancing the bending stiffness of each blade. In one embodiment, the ratio of the total tang surface area 66 that is embedded in the skirt to the total blade and tang surface areas ranges from 15 to 25%.

As the blade serrations are configured to point downwardly, the bottom opening of the skirt 8 must be configured to prevent inadvertent access to the blades 4, 6 from the bottom opening. In addition, the skirt 8 must be configured at a depth to sufficiently guide a bagel being cut through from the bottom opening 80 to the top opening 78 of the skirt 8. The cutting edge of the lower blade 6 is preferably offset a distance 60 of from about 0.472 to about 0.59 inch from the bottom opening to prevent access of an adult palm to the blade serrations. Parven neither teaches a skirt that surrounds its blade nor the concept of raising its blade a sufficient height within a skirt to prevent accidental exposure of a blade to its user. In contrast, the present slicer includes a skirt and blades that are far removed from fingers or hands of a user to prevent potential injury.

Figure 15:
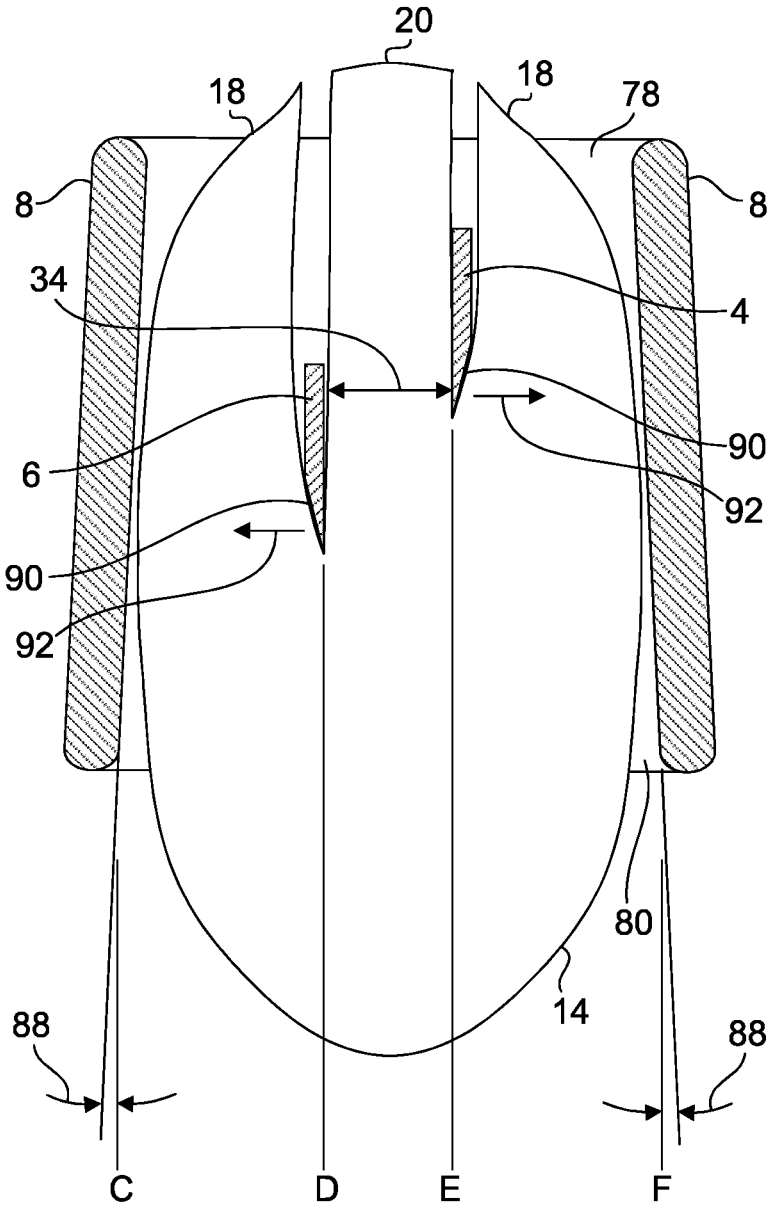
FIG. 15 is an orthogonal cross-sectional view as taken along line B-B of the bagel slicer of FIG. 8.

FIG. 15 is an orthogonal cross-sectional view as taken along line B-B of the bagel slicer of FIG. 8 depicting the blades 4, 6 and the skirt 8. In one embodiment, the Applicants discovered through repeated experimentation that the skirt 8 functions best if the lateral portions of the skirt 8 is inclined at an angle 88 of about 3 degrees. As such, the bottom opening 80 is configured slightly larger than the top opening 78, facilitating the insertion of a bagel 14 at the larger bottom opening 80 and securing of now thinner cut slices 18, 20 at the top opening 78 due to materials having been removed from the bagel 14 from cuts. Another critical feature of the blades of the present slicer deals with the arrangement of the blades 4, 6. The serrated knife edge 90 of each blade 4, 6 is disposed on the lateral side of the blade that faces away (in direction 92) from the middle slice 20 as depicted in FIG. 15. As the distance 34 between the blades 4, 6 is fixed, the middle slice 20 progresses in the cut direction without significant changes in the thickness. However, as cutting progresses, bagel materials at the serrated edge experience displacement away from the middle slice 20 due to the slope of the serrated knife edge 90. As the slicer is generally sized slightly larger than a bagel 14, such displacement does not create significant compression in an outer slice 18 to cause bunching of the bagel materials. It shall also be apparent from FIG. 15 that the present skirt serves as a guide for centering the bagel 14 as it is being cut, thereby resulting in bagel slices 18, 20 having consistent thicknesses and consumer acceptable cut surfaces.

We claim:

1. A food slicer for producing a plurality of slices from a single piece of food product, said food slicer comprising:

a. an oblong skirt having a length, two opposite ends, a width, a top edge, a bottom edge, a wall connecting said top edge to said bottom edge, a top opening defined by said top edge, a bottom opening defined by said bottom edge and a cavity defined by said wall, wherein said top opening is substantially parallel to said bottom opening, wherein the wall inclines at an angle so as to make the bottom opening slightly larger than the to opening; and b. an elongated upper blade and an elongated lower blade, wherein each of said upper and lower blades includes an elongated plate having a length and a height, two ends, a cutting edge, a second edge opposingly disposed from said cutting edge, said upper and lower blades form a combined height and are substantially parallelly disposed and offset vertically to form an overlap and each said blade is configured to laterally deflect a maximum distance of 0.13 inch with a force of 5 lbs. applied perpendicularly at about mid-section of said length of each of said blades, wherein the two ends of each blade are secured to the two opposite ends of the oblong skirt, wherein the cutting edge of each of said upper and lower blades is aligned with said bottom opening of said skirt and each said blade is perpendicular to said bottom opening and parallel to said skirt within said cavity, such that said food slicer is configured to receive the single piece of food product at said bottom opening and cut the single piece of food product to simultaneously result in one middle slice and two outer slices of food product at said top opening without exposing the cutting edge of each blade outside of said cavity, thereby ensuring safety of a user of said food slicer.

2. The food slicer of claim 1, wherein said overlap ranges from about 10 to about 30% of said combined height.

3. The food slicer of claim 1, wherein said second edge is a spine.

4. The food slicer of claim 1, further comprising a handle fixedly attached to a portion of said skirt.

5. The food slicer of claim 4, wherein said handle further comprises a loop configured for hanging said food slicer when not in use.

6. The food slicer of claim 1, wherein said skirt is constructed from a material selected from a group consisting of polypropylene, polycarbonate and polystyrene.

7. The food slicer of claim 1, wherein the cutting edge of said lower blade is offset a distance of from about 0.472 to about 0.59 inch from said bottom opening.

8. The food slicer of claim 1, wherein the cutting edge of each blade comprises a series of serrations having peaks and valleys.

9. The food slicer of claim 8, wherein said peaks and valleys of one of said blades are disposed alternatingly with said peaks and valleys of the other one of said blades in the longitudinal direction of each of said blades.

10. The food slicer of claim 8, wherein said series of serrations is disposed on only one lateral side of each said blade and said lateral side is disposed away from said middle slice.

11. A food slicer for producing a plurality of slices from a single piece of food product, said food slicer comprising:

a. an oblong skirt having a length, two opposite ends, a width, a top edge, a bottom edge, a wall connecting said top edge to said bottom edge, a top opening defined by said top edge, a bottom opening defined by said bottom edge and a cavity defined by said wall, wherein said top opening is substantially parallel to said bottom opening; wherein the wall inclines at an angle so as to make the bottom opening slightly larger than the top opening; and b. an elongated upper blade and an elongated lower blade, wherein each of said upper and lower blades includes an elongated plate having a length and a height, two ends, a cutting edge, a second edge opposingly disposed from said cutting edge, said upper and lower blades form a combined height and are substantially parallelly disposed and offset vertically to form an overlap of from about 10 to about 30% of said combined height, wherein the two ends of each blade are secured to the two opposite ends of the oblong skirt, wherein the cutting edge of each of said upper and lower blades is aligned with said bottom opening of said skirt and each said blade is perpendicular to said bottom opening and parallel to said skirt within said cavity, such that said food slicer is configured to receive the single piece of food product at said bottom opening and cut the single piece of food product to simultaneously result in one middle slice and two outer slices of food product at said top opening without exposing the cutting edge of each blade outside of said cavity, thereby ensuring safety of a user of said food slicer.

12. The food slicer of claim 11, wherein each said blade is configured to laterally deflect a maximum distance of 0.13 inch with a force of 5 lbs. applied perpendicularly at about mid-section of said length of each of said blades.

13. The food slicer of claim 11, wherein said second edge is a spine.

14. The food slicer of claim 11, wherein the cutting edge of said lower blade is offset a distance of from about 0.472 to about 0.59 inches from said bottom opening.

15. The food slicer of claim 11, wherein the cutting edge of each blade comprises a series of serrations having peaks and valleys.

16. The food slicer of claim 15, wherein said peaks and valleys of one of said blades are disposed alternatingly with said peaks and valleys of the other one of said blades in the longitudinal direction of each of said blades.

17. The food slicer of claim 15, wherein said series of serrations is disposed on only one lateral side of each said blade and said lateral side is disposed away from said middle slice.

18. The food slicer of claim 11, further comprising a handle fixedly attached to a portion of said skirt.

19. The food slicer of claim 18, wherein said handle further comprises a loop configured for hanging said food slicer when not in use.

* * * * *